United States Patent [19]

Lind

[11] 3,942,205

[45] Mar. 9, 1976

[54] SWIMMING PLATE WITH HANDLE

[75] Inventor: Roland Lind, Atvidaberg, Sweden

[73] Assignee: Gnosjoplast AB, Gnosjo, Sweden

[22] Filed: May 12, 1975

[21] Appl. No.: 576,823

[52] U.S. Cl. ..... 9/307; 9/310 J

[51] Int. Cl.[2] ..... A63B 31/02

[58] Field of Search ..... 9/14, 301, 307, 310 B, 9/310 E, 310 F, 310 J, 310 R, 311; 114/16 A, 16 F; 115/6, 6.1; 35/29 R, 29 B; 272/1 B, 71; D34/41–42

[56] References Cited

UNITED STATES PATENTS 3,039,415 6/1962 Foster ..... 9/310 R

D195,384 6/1963 Del Mar ..... D34/42

FOREIGN PATENTS OR APPLICATIONS 593,763 2/1934 Germany ..... 9/311

*Primary Examiner*—Trygve M. Blix
*Assistant Examiner*—Jesus D. Sotelo
*Attorney, Agent, or Firm*—Elliott I. Pollock

[57] ABSTRACT

A swimming plate of polyethylene plastic with a detachable handle in the form of a clam that stretches over the entire plate and whose outer legs grip in corresponding recesses in the plate.

1 Claim, 4 Drawing Figures

SWIMMING PLATE WITH HANDLE

This invention relates to a so-called swimming plate consisting of a plate provided with a handle, which floats on the water and which is used as a pedagogical means at swimming instruction and as a training device at training of back-stroke and life-saving.

Such swimming plates are previously known. In their simplest form they consist of a board of wood or cork with recesses at one edge for the hands or, more exactly, the fingers. Plates of this type with a rope nailed around the edge and forming loops similar to handles have also been used. Apart from the lacking resistance to water of the material which has made them slippery and very little apt to provide the feeling of safety desired at swimming instruction these plates have their handles in or at the edge. Due to this the plate will in turn tilt in the water and rather act as a drift-anchor. Especially at training of beginners (teaching of the legwork) this is a considerable disadvantage as the velocity is reduced, which does not act in a stimulating manner.

In addition to said disadvantage new constructions of swimming plates have also another disadvantage (but perhaps to a less degree); they have been made of STYROPOR plastic of a bad strength. Apart from the risks at a direct rupture in use these plates have crumbled in the swimming-pools and consequently also choked up filters.

The swimming plate of this invention has not the above-mentioned disadvantages and is substantially characterized in that the handles have been placed on the underside of the actual swimming plate in such a way that the centre line of the handle is located substantially straight under the centre of gravity of the displacement of the swimming plate when the plate is subjected to normal load in the handles.

Figure 1:
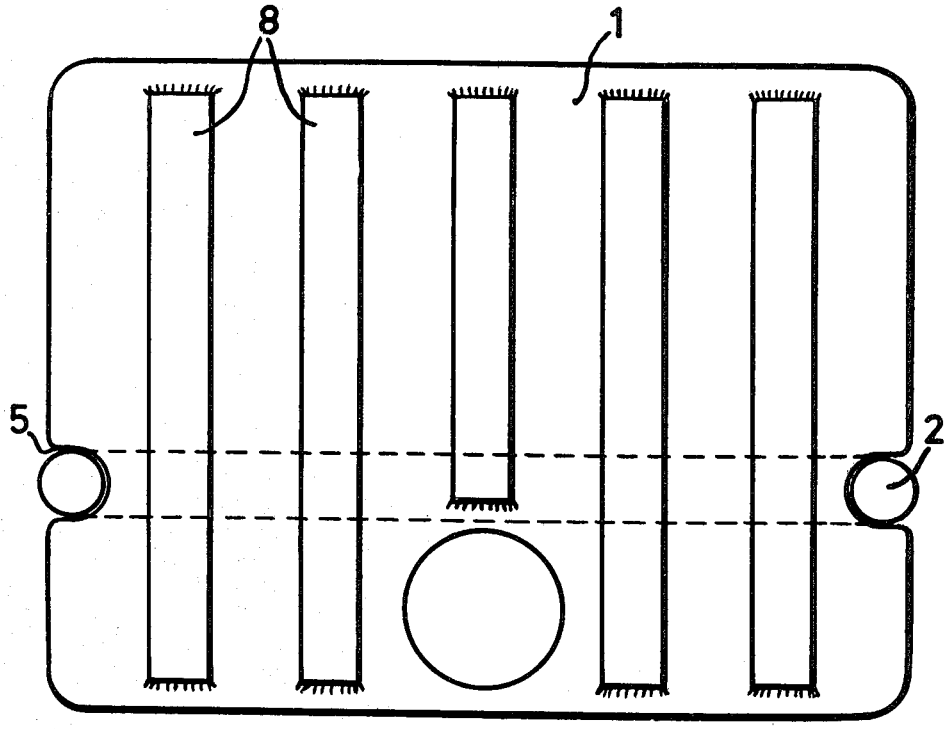
Figure 2:
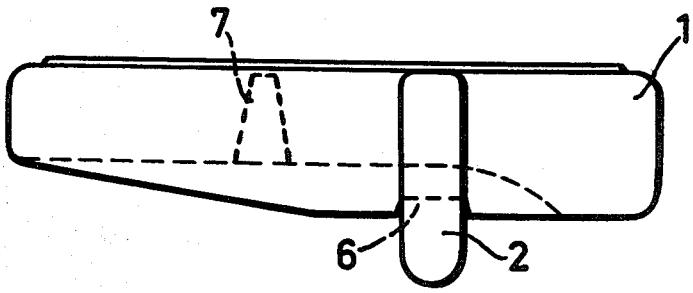
Figure 3:
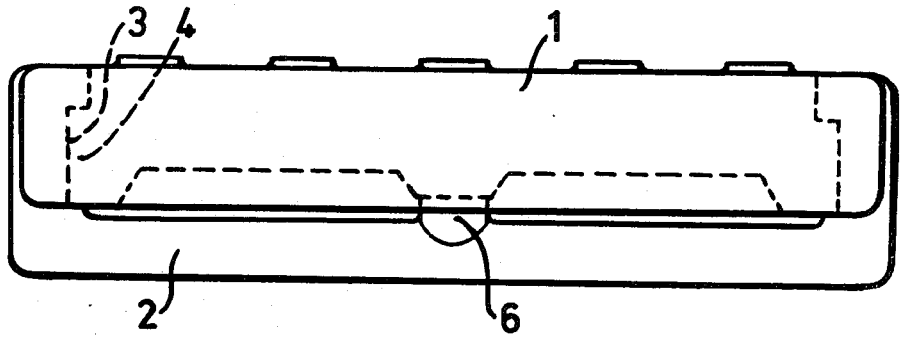
Figure 4:
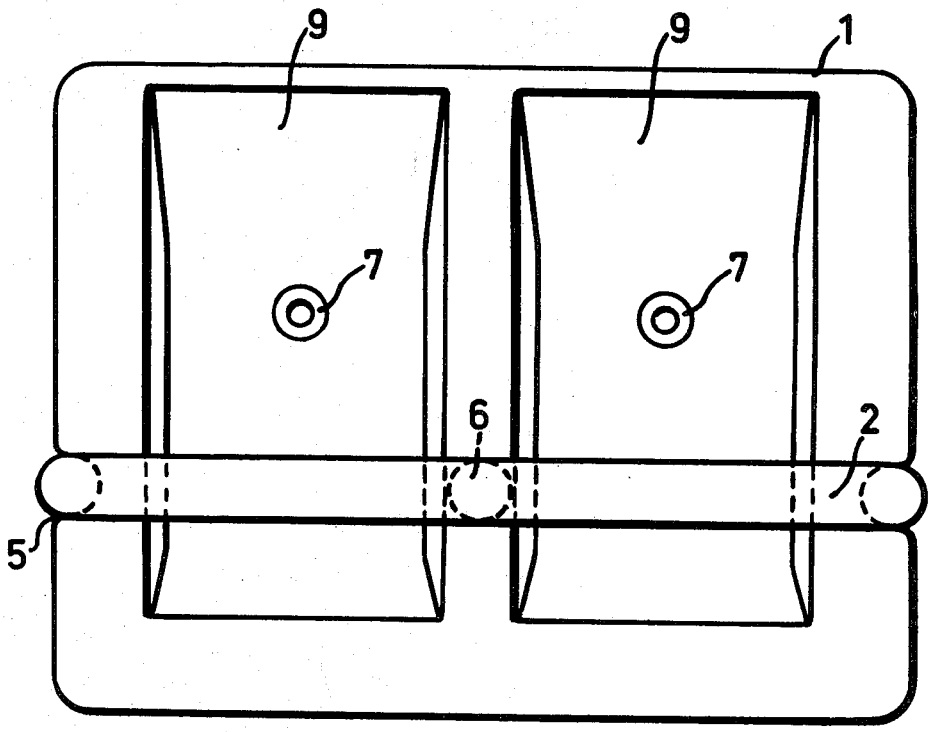

One embodiment of the invention which has been proved to be especially suitable will be described below more closely in connection with the enclosed drawings, where FIG. 1 is a top view of the plate, FIG. 2 is a side view and FIG. 3 is a front view (from below in FIG. 1). FIG. 4 shows the plate as seen from below.

The embodiment shown in the drawings is made as a stressed skin construction of polyethylene plastic, where the very plate forms one unit and the detachable handle 2 forms the other part. The handle 2 has been made detachable substantially to make transports easier. As is evident from FIG. 3 the handle is designed as a strong clamp, whose outer legs have been provided with a groove 3, which engages a corresponding semi-circular shoulder 4 in a recess 5 in the plate.

The handle 2, which is itself a supporting part of the swimming plate, is moreover provided with a shoulder 6, which fits in a recess on the underside of the plate 1, which increases the stability of the construction. The handle is serrated and is of such a thickness (about 3 cm) that small children in particular should have a feeling of safety.

In order to increase the stability of the very plate 1 it is provided with two casting holes or, more exactly, hollow casting pins 7 as well as five stiffening rims of a width of about 2 cm on the upper side 8.

On the underside two embedments 9 have been designed to provide space for the hands and to contribute to the stability of the plate.

Apart from these embedments 9 the underside of the plate is slightly V-shaped so that the front edge is somewhat thicker than the rear edge. This contributes to its stability, i.e. reduces the tendency to tilting. However, what is most important in this connection is the location of the handle relative to the centre of gravity of the displacement, when the swimming plate is put under normal load. If this centre of gravity is substantially straight above the handle it will constantly try to hold the plate in a horizontal position, and a very good stability is obtained.

In combination with the hands being under the water surface this will simplify the desired relaxation in the shoulders, and will give a correct position in the water already from the start, which in turn contributes to a more rapid learning and a more pleasant training.

What is claimed is:

1. Swimming plate with a handle of a type as used as a pedagogical means at swimming instruction and as a training means at training of back-stroke and life-saving, where a handle is placed under the swimming plate and where the underside of the plate, as seen from the side, is made slightly V-shaped, the front edge being thicker than the rear edge and the attachment of the handle being spaced relative to the front edge, characterized in that the plate is designed as a stressed skin construction of polyethylene plastic or the like, where the plate forms a unit and the handle a detachable second unit, the handle being designed as a strong hollow clamp, whose outer legs are designed with a groove, which engages a corresponding semi-circular shoulder in a recess in the plate, the handle moreover being provided with a shoulder, which fits in a recess on the underside of the plate and increases the stability of the construction.

* * * * *